United States Patent [19]

Sakamaki et al.

[11] Patent Number: 5,030,074

[45] Date of Patent: Jul. 9, 1991

[54] ROTARY MACHINE WITH DYNAMIC PRESSURE BEARING GROOVES ON VANE GUIDE RING

[75] Inventors: Hiroshi Sakamaki; Yukio Horikoshi; Takeshi Jinnouchi; Kenji Tanzawa, all of Sakado, Japan

[73] Assignee: Eagle Industry Co., Ltd., Tokyo, Japan

[21] Appl. No.: 394,778

[22] Filed: Aug. 16, 1989

Related U.S. Application Data

[60] Division of Ser. No. 197,548, May 23, 1988, Pat. No. 4,958,995, which is a continuation-in-part of Ser. No. 75,006, Jul. 17, 1987, abandoned, and Ser. No. 110,919, Oct. 21, 1987, abandoned, and Ser. No. 113,568, Oct. 26, 1987, abandoned, and Ser. No. 115,677, Oct. 30, 1987, abandoned.

[30] Foreign Application Priority Data

| | | | |
|---|---|---|---|
| Jul. 22, 1986 | [JP] | Japan | 61-111490[U] |
| Jul. 22, 1986 | [JP] | Japan | 61-170903 |
| Oct. 23, 1986 | [JP] | Japan | 61-161609[U] |
| Oct. 23, 1986 | [JP] | Japan | 61-161610[U] |
| Nov. 4, 1986 | [JP] | Japan | 61-168145[U] |
| Nov. 4, 1986 | [JP] | Japan | 61-168147[U] |
| Nov. 14, 1986 | [JP] | Japan | 61-269960[U] |
| Nov. 14, 1986 | [JP] | Japan | 61-269961 |
| Nov. 17, 1986 | [JP] | Japan | 61-271934 |
| Nov. 21, 1986 | [JP] | Japan | 61-178287[U] |
| Nov. 21, 1986 | [JP] | Japan | 61-178288[U] |
| Nov. 21, 1986 | [JP] | Japan | 61-273390 |
| Nov. 21, 1986 | [JP] | Japan | 61-276689 |
| Dec. 3, 1986 | [JP] | Japan | 61-185571[U] |

[51] Int. Cl.[5] ..... F01C 1/344; F16C 32/06

[52] U.S. Cl. ..... 418/256; 418/265; 384/112; 384/113; 384/292; 384/901

[58] Field of Search ..... 418/256, 257, 260, 261, 418/264, 265; 384/112, 113, 115, 123, 292, 901

[56] References Cited

U.S. PATENT DOCUMENTS

| | | | |
|---|---|---|---|
| 1,444,269 | 2/1923 | Piatt | 418/257 |
| 1,669,779 | 5/1928 | Reavell | 418/265 |
| 1,674,453 | 6/1928 | Sloper | 384/292 |
| 3,988,083 | 10/1976 | Shimizu et al. | 418/264 |
| 4,558,960 | 12/1985 | Lehtinen et al. | 384/292 |
| 4,699,525 | 10/1987 | Mizobuchi et al. | 384/112 |

FOREIGN PATENT DOCUMENTS

| | | | |
|---|---|---|---|
| 284362 | 1/1928 | United Kingdom | 418/256 |

*Primary Examiner*—John J. Vrablik
*Attorney, Agent, or Firm*—Jordan and Hamburg

[57] ABSTRACT

A rotary machine for handling a fluid includes a housing having a rotor chamber and a rotor rotatably mounted in the chamber. The rotor has a plurality of generally radially disposed vane slots, and a plurality of vanes are slidably mounted in the vane slots and operable to define variable volume chambers for the fluid as the rotor rotates and the vanes move generally radially in and out of the vane slots. The vanes have projections projecting from the longitudinal ends thereof, and the housing has annular rings having inner cylindrical surfaces disposed to be engaged by projections. Grooves on the outer surface of the rings are operable to produce a layer of fluid between such outer surface and the housing to thereby minimize the frictional rotational resistance of the rings on the housing, the rings thereby being rotated in approximately synchronization with the rotor.

11 Claims, 7 Drawing Sheets

ROTARY MACHINE WITH DYNAMIC PRESSURE BEARING GROOVES ON VANE GUIDE RING

RELATED APPLICATIONS

This is a division application of U.S. Ser. No. 197,548, filed May 23, 1988, U.S. Pat. No. 4,958,995, which is a Continuation-in-part application of U.S. Ser. No. 075,006 filed July 17, 1987, abandoned; U.S. Ser. No. 110,919 filed Oct. 21, 1987, abandoned; U.S. Ser. No. 113,568 filed Oct. 26, 1987, abandoned; and U.S. Ser. No. 115,677 filed Oct. 30, 1987, abandoned.

BACKGROUND OF THE INVENTION

The present invention relates to a vane pump which is one of rotary pumps used for various kinds of apparatuses such as a supercharger of an engine, a compressor of a freezing cycle, and the like.

A vane pump schematically shown in FIG. 12 has been heretofore widely known.

In FIG. 12, reference numeral 101 designates a housing; 102, a rotor inserted eccentrically into an inner peripheral space of the housing 101 and rotatably supported by a rotational shaft 103; 105*a*, 105*b* and 105*c*, plate-like vanes disposed radially retractably from vane grooves 104*a*, 104*b* and 104*c* equally spaced apart so as to peripherally divide the outer peripheral side of the rotor 102 into three sections. When the rotor 102 is rotated in the direction as indicated by the arrow X by the rotational shaft 103, the vanes 105*a*, 105*b* and 105*c* are moved out in the direction of the outside diameter by the centrifugal force, and the end edges thereof rotate while slidably contacting the inner peripheral surface of the housing 101. Since the rotor 102 is eccentric with respect to the housing 101 as previously mentioned, as such rotation occurs, volumes of working spaces 106*a*, 106*b* and 106*c* defined by the housing 101, the rotor 102 and the vanes 105*a*, 105*b* and 105*c* are repeatedly enlarged and contracted to allow a fluid taken in from an intake port 107 to be discharged out of an outlet port 108.

However, the above-described conventional vane pump has problems that since the vanes slidably move along the inner peripheral surface of the housing at high speeds, the efficiency of the volume caused by the great power loss due to the sliding resistance and by the generation of high sliding heat unavoidably deteriorates; the vanes materially become worn; and the vanes are expanded due to the generation of sliding heat to produce a galling with the inner side surfaces of both end walls of the housing, and the like.

In view of these problems as noted above, it is an object of the present invention to enhance the efficiency of such a pump and enhance the durability thereof.

SUMMARY OF THE INVENTION

According to the present invention, the protrusion of the vane from the vane groove is not defined by the contact thereof with the inner peripheral surface of the housing, but it is defined in a manner such that the end edge of the vane depicts a certain locus by the engagement of the projections such as pins provided on the vane with the annular race formed on the side of the housing. The vane may be rotated in the state in which the vane is not in contact with the inner surface of the housing, and therefore, the present invention has excellent advantages which can prevent the deterioration of the efficiency of the pump caused by the sliding resistance and the wear of the vane; and which can prevent occurrence of inconvenience resulting from an increase in sliding heat.

A vane pump according the present invention is also designed so that rings are disposed coaxially with the inner peripheral surface of a housing and rotatably internally of both end walls of the housing, and fluid layer producing means on the outer surface of the rings and operable to produce a layer of fluid between such outer surface and the housing to thereby minimize the frictional rotational resistance of the rings on the housing, the rings thereby being rotated in approximate synchronization with the rotor which is rotatably mounted in the housing.

While the present invention has been briefly outlined, the above and other objects and new features of the present invention will be fully understood from the reading of the ensuing detailed description in conjunction with embodiments shown in the accompanying drawings. It is to be noted that the drawings are exclusively used to show certain embodiments for the understanding of the present invention and are not intended to limit the scope of this invention.

DESCRIPTION OF THE PREFERRED EMBODIMENTS

A fundamental exemplification of a vane pump according to the present invention will now be described with reference to FIGS. 1 to 3.

Figure 1:
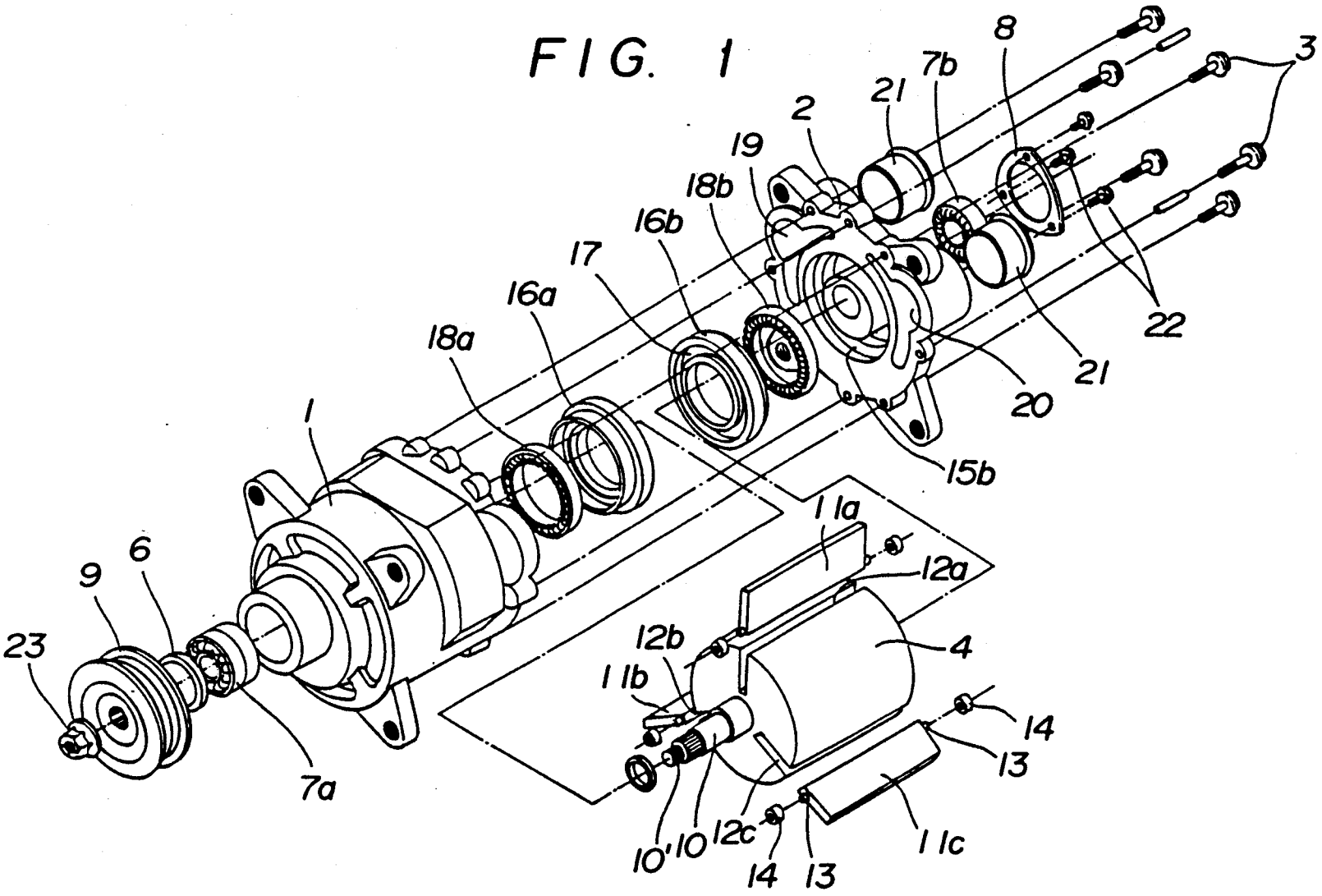
FIG. 1 is an exploded perspective view of a vane pump according to a fundamental embodiment of the present invention.
Figure 2:
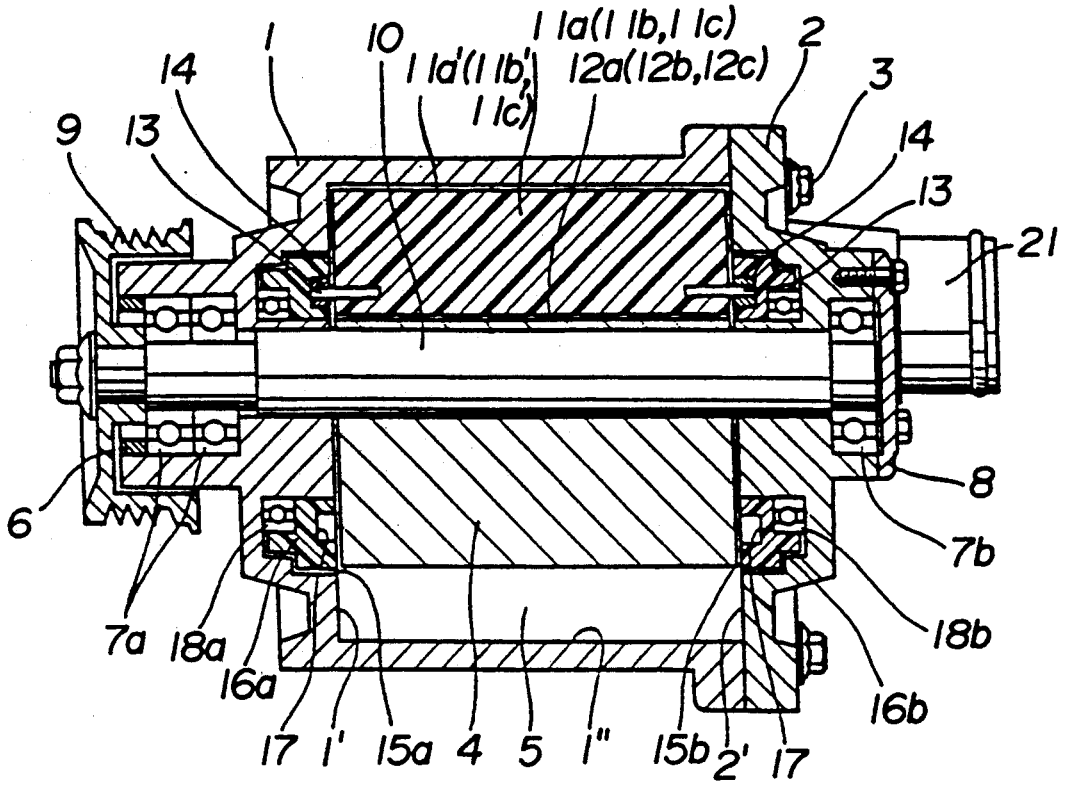
FIG. 2 is a sectional view showing the pump of FIG. 1 assembled.
Figure 3:
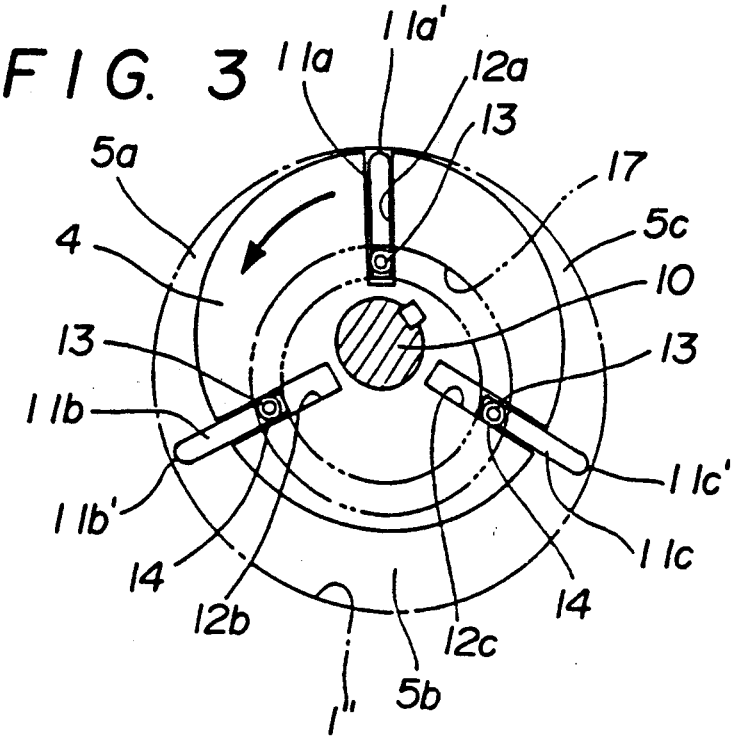
FIG. 3 is a side view of a rotor of the same pump of FIG. 1.

In FIGS. 1 and 2, a front housing 1 and a rear housing 2, both of which housings are made of non-ferrous metal such as aluminum, which is light in weight and is small in the coefficient of thermal expansion, are secured integral with each other by means of bolts 3. A rotor 4 made of iron eccentrically inserted into an inner peripheral space 5 of the housing is extended through both the housings 1 and 2 through a ball bearing 7*a* held by a fixed ring 6 in anti-slipout fashion in an axial shoulder of the front housing 1 and a ball bearing 7*b* held by a bearing cover 8 in anti-slipout fashion in an axial shoulder of the rear housing 2 and is rotatably mounted on a rotational shaft 10 to which a drive force is transmitted from a pulley 9. Plate-like vanes 11*a*, 11*b* and 11*c* principally made of a carbon material having an excellent slidability are disposed to be radially projected and retracted in vane grooves 12*a*, 12*b* and 12*c*, respectively, which are formed in the form of depressions equally spaced apart so as to peripherally divide the outer peripheral side of the rotor 4 into three sections, on the rotor 4. On opposite ends of each of the vanes 11*a*, 11*b* and 11*c* corresponding to axial opposite sides of the rotor 4 are projected steel pins 13 and 13, respectively, and a sleeve bearing 14 made of resin having excellent slidability and abrasion resistance is slipped over each of pins 13. In annular recesses 15*a* and 15*b* formed in inner surfaces 1' and 2' of end walls where the front housing 1 and the rear housing 2 are opposed to each other coaxial with the inner peripheral space 5 of the housing (coaxial with the inner peripheral surface 1'' of the front housing 1), retainer rings 16*a* and 16*b* made of non-ferrous metal such as aluminum and each having an annular race 17 are rotatably fitted through ball bearings 18*a* and 18*b*, respectively. The pins 13 and 13 projected on the respective vanes 11*a*, 11*b* and 11*c* peripherally slidably engage the annular races 17 and 17 of the retainer rings 16*a* and 16*b* through the respective sleeve bearings 14. This engagement defines the radial movement of the vanes 11*a*, 11*b* and 11*c* during rotation so as to maintain a state in which there is formed a slight clearance between the end edges 11*a'*, 11*b'* and 11*c'* (see FIG. 3) thereof and the inner peripheral surface 1'' of the front housing 1. An intake port 19 for guiding a fluid into the inner peripheral space 5 of the housing from the exterior of the pump and an outlet port 20 for guiding a fluid to the exterior from the inner peripheral space 5 of the housing are formed in the rear housing 2. Reference numerals 21, 21 designate tubes mounted on the intake port 19 and outlet port 20, respectively; 22 a bolt used to secure the bearing cover 8 to the rear housing 2; and 23, a nut in engagement with an external thread 10' of the end of the rotational shaft 10 in order to secure the pulley 9 to the rotational shaft 10.

The operation of the above-described vane pump will be described hereinafter. When the rotational shaft 10 and rotor 4 are rotated by the drive force from the pulley 9, the vanes 11*a*, 11*b* and 11*c* also rotate, and the 13 projected on the vanes 11*a*, 11*b* and 11*c*, respectively, and the sleeve bearings 14 and 14 slipped over the pins 13 and 13 rotate along the annular races 17 and 17. Since as shown in FIG. 3, the inner peripheral surface 1'' of the housing and the annular race 17 are in coaxial relation and the annular race 17 and the rotor 4 are in eccentric relation, the vanes 11*a*, 11*b* and 11*c* are radially slidably moved in the vane grooves 12*a*, 12*b* and 12*c* of the rotor 4 to be projected and retracted repeatedly with the result that the volumes of the working spaces 5*a*, 5*b* and 5*c* defined by both the housings 1, 2, the rotor 4 and the vanes 11*a*, 11*b* and 11*c* repeatedly increase and decrease. That is, in FIG. 3, the working space 5*a*, with the rotation, increases its volume to suck the fluid from the intake port 19 (not shown; see FIG. 1) opening to portion 5*a*; the working space 5*c*, with the rotation, decreases its volume to discharge the fluid into the outlet port 20 (not shown; see FIG. 1) opening to portion 5*c*; and the working space 5*b* transfers the thus sucked fluid toward the outlet port 20. In the above-described operation, the end edges 11*a'*, 11*b'* and 11*c'* of the vanes 11*a*, 11*b* and 11*c* are not in sliding contact with the inner peripheral surface 1'' of the front housing, as previously mentioned, and therefore, abrasion or high heat hardly occurs. In addition, the sleeve bearing 14 slipped over the pin 13 is slidably rotated while being pressed against the outside diameter side by the centrifugal force within the annular race 17 of the retainer rings 16*a* and 16*b* while the retainer rings 16*a* and 16*b* follow the sleeve bearing 14 for rotation because the former are in the state to be rotatable by the ball bearings 18*a* and 18*b*, respectively. The relative sliding speed between the sleeve bearing 14 and the annular race 17 is low whereby the abrasions of annular race 17, retainer rings 16*a* and 16*b*, the sleeve bearing 14 and the like can be minimized.

It is believed that the fundamental mode of the present invention is now fully understood from the above-described description. The pump of the first embodiment shown in FIGS. 1 to 3 constitutes, in a sense, the core of the variations described below.

FIGS. 26 and 27 show one embodiment of the present invention wherein the inner peripheral surface of a housing internally of both end walls of the housing, and projections provided on both side ends of vanes opposed to said end walls and the inner peripheral surfaces of the bearings are brought into contact with each other to define the protrusion of the vanes during rotation.

That is, the vane pump belonging to the type 6 is designed to use bearings in place of the retainer rings used in the vane pumps as previously described to save the trouble of forming annular races in the retainer rings. According to this arrangement, in the vane moved out of the vane groove by virtue of the centrifugal force during rotation, the projections on the opposite ends thereof come into contact with the inner peripheral surfaces of the bearings provided coaxially of the inner peripheral surface of the housing, in other words, in eccentric fashion with respect to the rotor whereby the radial movement thereof is defined, and the vane rotates in non-contact with the housing. In that case, the bearings are also rotated approximately in synchronism with the rotor by the contact of the projections of the vane, and therefore the relative sliding movement between the bearings and the projections of the vane can be minimized.

Figure 4:
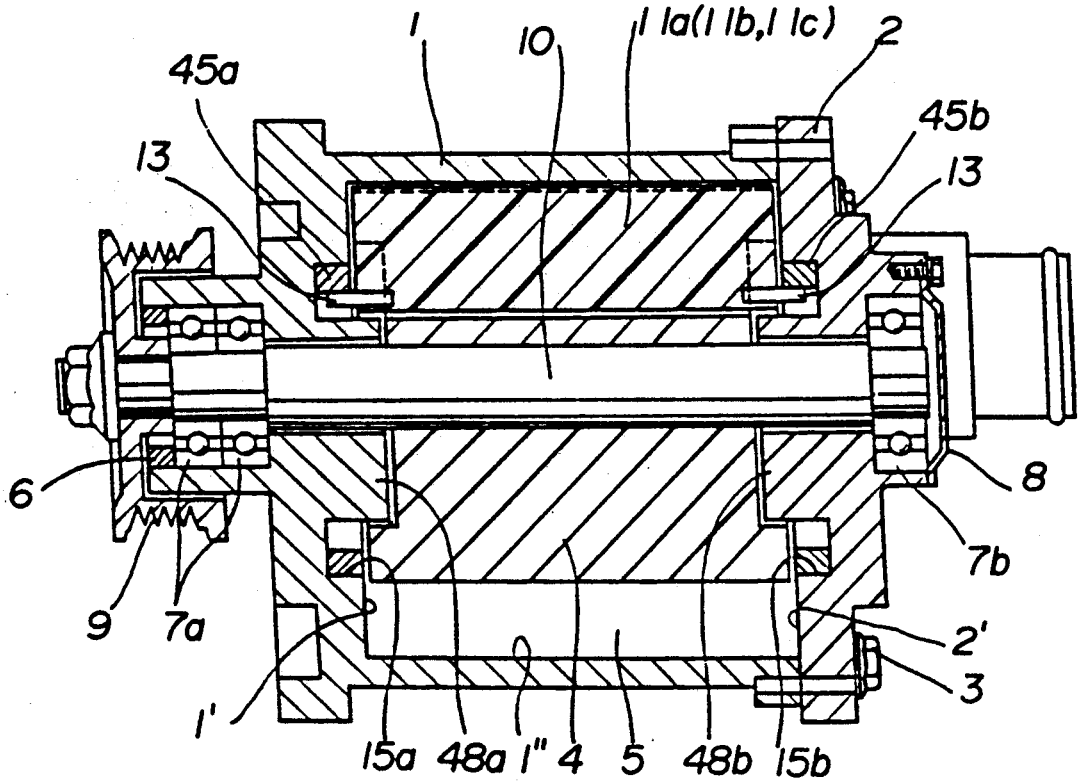
FIG. 4 is a sectional view of a vane pump belonging to another embodiment.
Figure 5:
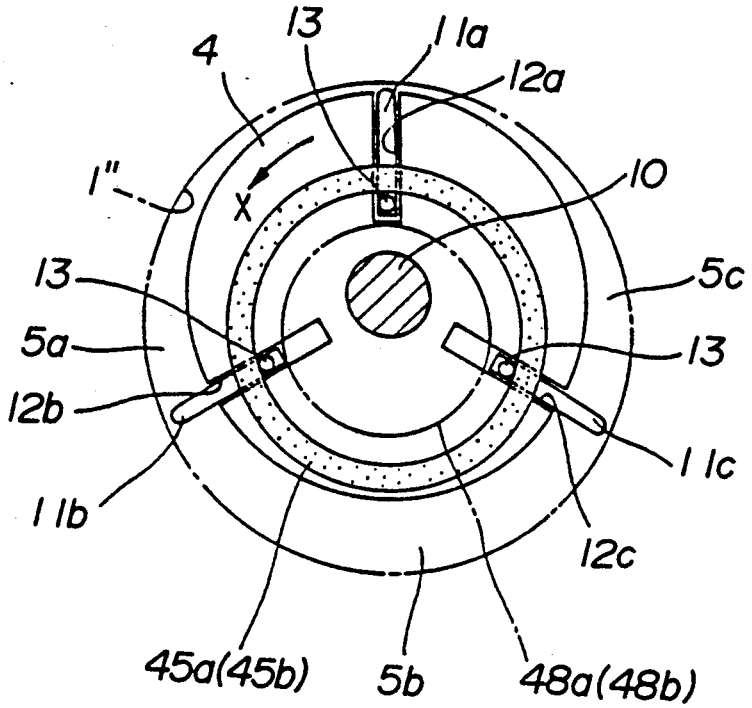
FIG. 5 is a side view of a rotor of the same pump.
Figure 6I:
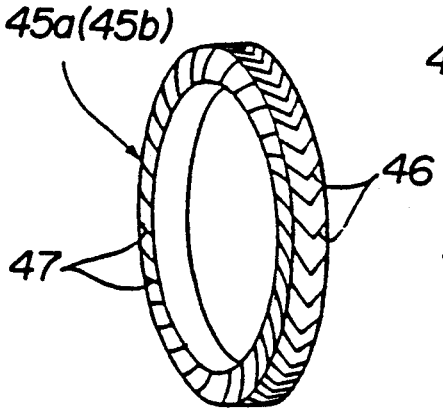
FIG. 6(I) and 6(II) are respective perspective views of retainer rings.
Figure 6:
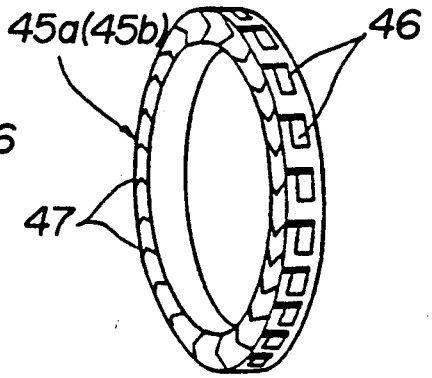

In FIGS. 4 and 5, journal bearings 45*a* and 45*b* formed of light-weight material such as aluminum are rotatably loosely mounted in annular recesses 15*a* and 15*b* formed coaxially with the inner peripheral surface of a housing in the inner surfaces 1' and 2' of both end walls of the housing, and the opposed peripheral surface (outer peripheral surface) and the opposed side with respect to the annular recesses 15*a* and 15*b* in journal bearings 45*a* and 45*b* are formed with dynamic pressure producing grooves 46 and 47 as shown in FIGS. 6(I) and 6(II). Pins 13 and 13 of vanes 11*a*, 11*b* and 11*c* are located on the inner peripheral sides of the journal bearings 45*a* and 45*b*, and the pins 13 and 13 come into contact with the inner peripheral surfaces of the bearings 45*a* and 45*b* during rotation whereby the vanes 11*a*, 11*b* and 11*c* are defined in their radial movement and can rotate in non-contact with the inner peripheral surface of the housing. Small-diameter bosses indicated at 48*a* and 48*b* are provided to impede unnecessary retraction of the vanes 11*a*, 11*b* and 11*c* into the vane grooves 12*a*, 12*b* and 12*c* when the pump stops, and to avoid an excessive shock between the pins 13 and 13 and the journal bearings 45*a* and 45*b* caused by the sudden protrusion of the vanes 11*a*, 11*b* and 11*c* when the pump starts, the bosses being projected concentric with the annular recesses 15*a* and 15*b*. This vane pump is constructed as described above. When the rotational shaft 10 and the rotor 4 are rotated in the direction as indicated at X by the drive force from the pulley 9, the vanes 11*a*, 11*b* and 11*c* rotate in non-contact with the front housing 1 and the rear housing 2 with the pins 13 and 13 placed in contact with the inner peripheral surfaces of the journal bearings 45*a* and 45*b* by virtue of the centrifugal force.

In the above-described operation, the vanes 11*a*, 11*b* and 11*c* are totally free from sliding contact with the front housing 1 and rear housing 12 as previously mentioned while the pins 13 and 13 integral with the vanes 11*a*, 11*b* and 11*c* come into sliding contact with the journal bearings 45*a* and 45*b'* but the amount of sliding contact thereof is small because the journal bearings 45*a* and 45*b* rotate approximately in synchronism with the rotor 4 by the frictional force with respect to the pins 13 and 13. Since the rotation of the journal bearings 45*a* and 45*b* is effected in a floated fashion by a great dynamic pressure produced in a fluid layer between the annular recesses 15*a* and 15*b* on the housing side by the dynamic pressure producing grooves 46 and 47, the sliding resistance is very small. For these reasons, it is possible to minimize the deterioration of the efficiency and abrasion resulting from the sliding resistance and sliding heat, and the temperature of the discharged fluid also lowers.

Figure 7:
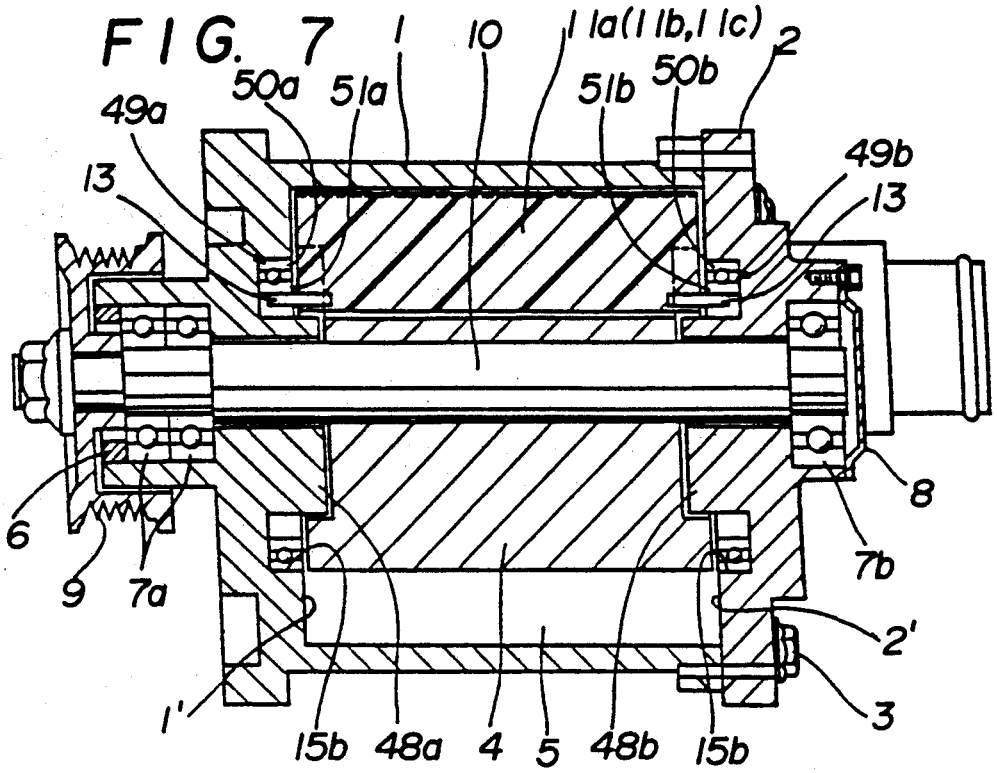
FIG. 7 is a sectional view of the vane pump belonging to the same type 6.

Next, a pump shown in FIG. 7 uses ball bearings 49*a* and 49*b* in place of the journal bearings 45*a* and 45*b* in the pump shown in FIG. 4, and the ball bearings 49*a* and 49*b* are mounted in the annular recesses 15*a* and 15*b* of the inner surfaces 1' and 2' of both end walls of the housing. That is, the ball bearings 49*a* and 49*b* have their outer races 50*a* and 50*b* fitted and secured to the inner peripheral surfaces of the annular recesses 15*a* and 15*b*, and the pins 13 and 13 come into contact with the inner peripheral surfaces of the the inner races 51*a* and 51*b* whereby the inner races 51*a* and 51*b* rotate approximately in synchronism with the rotor 4, which pump has the function substantially equal to the pump of FIG. 26.

It is to be noted that since the rotor is eccentric, the relative angle between the vane and the inner peripheral surface of the housing repeatedly varies as rotation proceeds, and therefore, in the event the protrusion of the vane is defined as shown in the aforesaid drawings, the locus of the end edge of the vane assumes an approximate elliptic shape. It is therefore desirable that the inner peripheral surface of the housing is formed into a shape corresponding to the aforesaid locus so as to always maintain constant a clearance between the end edge of the vane and the inner peripheral surface of the housing.

The vane pump described above is designed so that the projections provided on the opposite side ends of the vane are placed in contact with the inner peripheral surface of the bearings provided coaxial with the inner peripheral surface of the housing and rotatably to define the radial movement thereof so that the vane may be rotated in non-contact with the housing, as described above. Therefore, it is possible to minimize the deterioration of the pump efficiency and the advance of abrasion resulting from the sliding resistance and the high sliding heat and to lower the temperature of fluids discharged from the pump, this exhibiting excellence performances for use with various apparatuses such as a super-charger in an engine, a compressor in a freezing cycle, and the like.

Another embodiment has a dynamic pressure bearing mechanism provided on the end or peripheral surface of a retainer, and particularly being characterized in that said dynamic pressure bearing mechanism comprises a groove or recess capable of producing dynamic pressure such as a spiral groove, a Rayleigh step groove or a herringbone groove or a recess or a combination of the aforesaid grooves and the recess.

Figure 8:
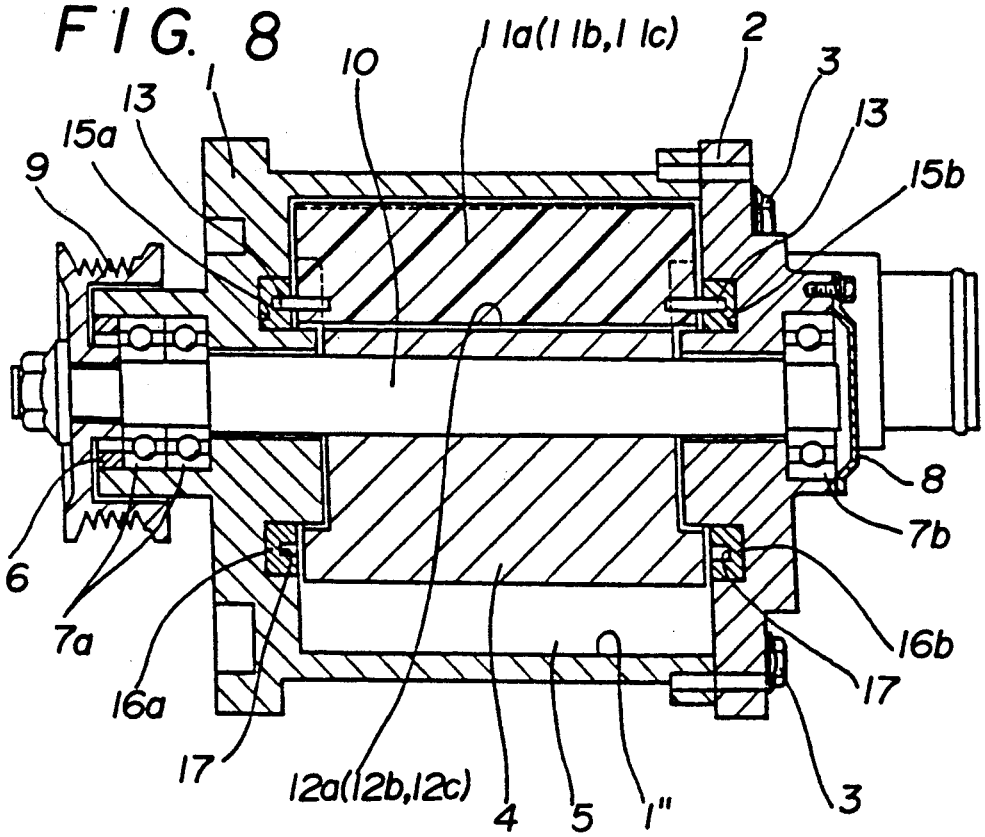
FIG. 8 is a sectional view of a vane pump belonging to another embodiment.
Figure 9:
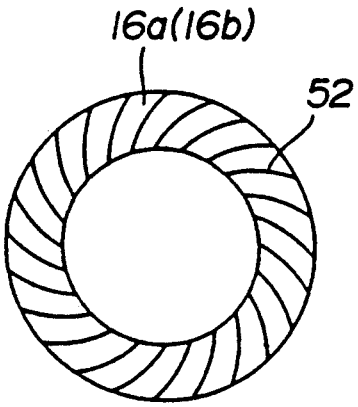
FIGS. 9, 10 and 11 are respective perspective views of a retainer rings.
Figure 10:
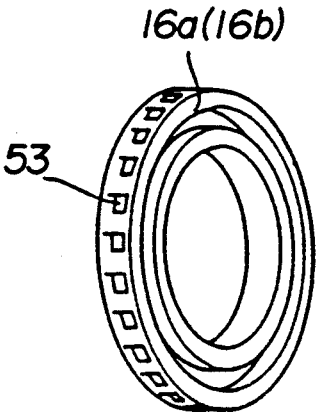
Figure 11:
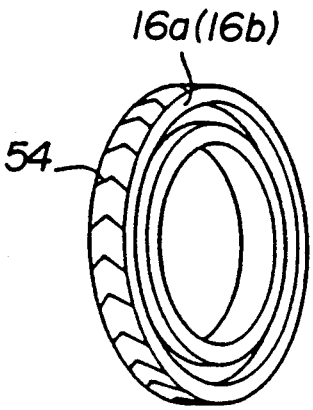
Figure 12:
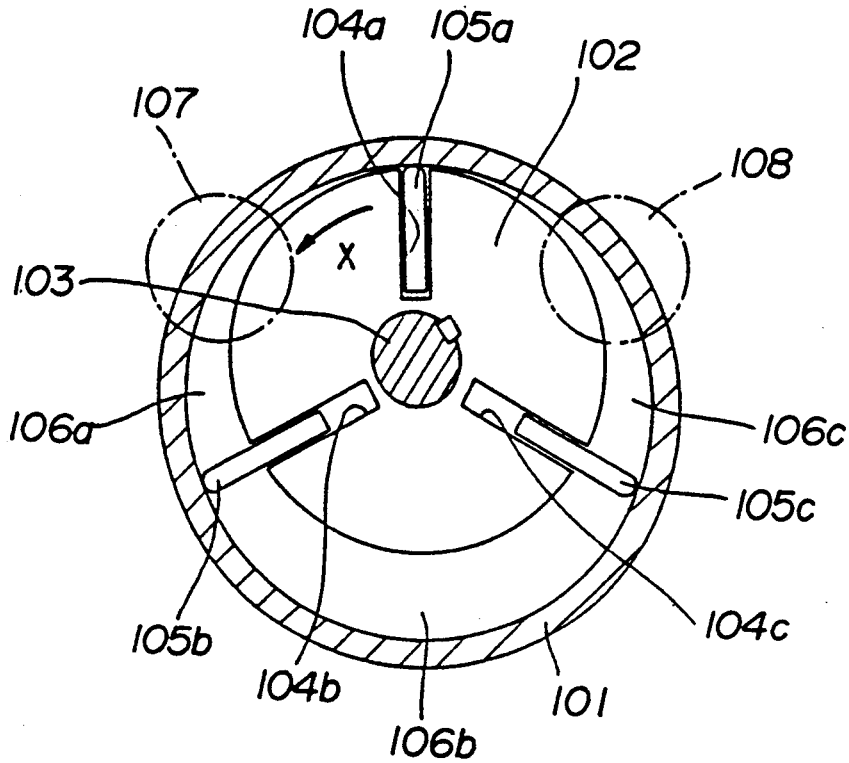
FIG. 12 PRIOR ART
FIG. 12 is a sectional view showing one example of a vane pump according to the prior art.

One example of the vane pump belonging to this embodiment will be described hereinafter with reference to FIG. 8. outer ends of the retainer rings 16*a* and 16*b* are mounted opposed to the inner side of the housing 1 are formed with spiral grooves 52 as shown in FIG. 9, and the outer peripheral surfaces thereof formed with Rayleigh step grooves 53 and herringbone grooves 54 as shown in FIGS. 10 and 11. The dynamic pressure bearing mechanism is provided to smoothly rotate the retainer rings 16*a* and 16*b* with respect to the housing 1.

The pins 13 are slidably rotated while being pressed against the outside diameter side by the centrifugal force within the annular race 16 of the retainer plates 15*a* and 15*b* but the retainer plates 15*a* and 15*b* follow the pins 13 and rotate since the retainer plates 15*a* and 15*b* are in the state in which they may be smoothly rotated by the dynamic pressure bearing mechanism. The relative sliding speed between the pins 13 and the annular race 16 is very small thereby minimizing the abrasions of the annular race 16, retainer plates 15*a*, 15*a*, pins 13, etc. The aforesaid dynamic pressure bearing mechanism can be replaced, in addition to the already mentioned spiral grooves 52, Rayleigh step grooves 53 and herringbone grooves 54, by various grooves, recesses and a combination of these which can produce dynamic pressure in a manner similar to the former.

While we have described the preferred embodiment of the present invention, it will be obvious that various other modifications can be made without departing from the principle of the present invention. Accordingly, it is desired that all the modifications that may substantially obtain the effect of the present invention through the use of the structure substantially identical with or corresponding to the present invention are included in the scope of the present invention.

This application incorporates herein the disclosures of U.S. Ser. No. 075,006, filed July 17, 1987; U.S. Ser. No. 110,919 filed Oct. 21, 1987; U.S. Ser. No. 113,568 filed Oct. 26, 1987; and U.S. Ser. No. 115,677 filed Oct. 30, 1987.

What we claim is:

1. A rotary machine for handling a fluid comprising a housing means having a rotor chamber, said rotor chamber having an inner peripheral surface, a rotor means rotatably mounted in said chamber, said rotor means having an axis of rotation, said inner peripheral surface having a central axis which is eccentrically disposed relative to said axis of rotation of said rotor means, said rotor means having a plurality of generally radially disposed vane slots, a plurality of vane means slidably mounted in said vane slots and operable to define variable volume chambers for said fluid as said rotor means rotates and said vane means move generally radially in and out of said vane slots, said vane means having longitudinal ends, projection means projecting from said longitudinal ends, said housing means having annular ring means coaxial with said central axis, said ring means having an inner cylindrical surface disposed to be engaged by said projecting means such that during rotation of said rotor means, the resulting centrifugal force urges said vane means radially outwardly of the respective vane slot such that said projection means engages said inner cylindrical surface to limit the extent of outward radial movement of said vane means from its respective vane slot to preclude sliding contact between said vane means and said inner peripheral surface of said housing means, said ring means having at least one outer surface, and groove means on said outer surface operable to produce a layer of said fluid between said outer surface and said housing means to thereby minimize the frictional rotational resistance of said ring means on said housing means, said ring means thereby being rotated in approximate synchronization with said rotor means by the frictional contact between said projection means and said inner cylindrical surface of said ring means.

2. A rotary machine according to claim 1, wherein said ring means has an outer peripheral surface and an end surface perpendicular to said central axis, said groove means comprising grooves which are formed on said outer peripheral surface and on said end surface of said ring means.

3. A rotary machine according to claim 2, wherein said housing means has end walls which define longitudinal ends of said rotor chamber, annular recess means in said end walls coaxial with said central axis, said ring means being rotatable in said recess means, each of said recesses having a radially outer cylindrical wall and a bottom wall perpendicular to said central axis, said layer of fluid being formed between said outer peripheral surface of said ring means and said radially outer cylindrical wall of said recess and between said end surface of said ring means and said bottom wall of said recess.

4. A rotary machine according to claim 3, wherein said radially outer cylindrical wall of said recess means is an uninterrupted cylindrical wall devoid of openings to thereby enable maintaining said layer of fluid between said outer peripheral surface of said ring means and said radially outer cylindrical wall of said recess means during rotation of said ring means in said channel.

5. A rotary machine according to claim 2, wherein said grooves are helical grooves.

6. A rotary machine according to claim 2, wherein said grooves are herringbone grooves.

7. A rotary machine according to claim 2, wherein said grooves are Raleigh-step grooves.

8. A rotary machine for handling a fluid comprising a housing means having a rotor chamber, said rotor chamber having an inner peripheral surface, a rotor means rotatably mounted in said rotor chamber, said inner peripheral surface having a central axis which is eccentrically disposed relative to the axis of rotation of said rotor means, said rotor means having a plurality of generally radially disposed vane slots, a plurality of vane means slidably mounted in said vane slots and operable to define variable volume chambers for said fluid as said rotor means rotates and said vane means move generally radially in and out of said vane slots, said vane means having longitudinal ends, projection means projecting from said longitudinal ends, said housing means having end walls which define longitudinal ends of said rotor chamber, annular recesses in said end walls coaxial with said central axis, said recesses having recess walls, annular ring means rotatable in said annular recesses about said central axis, said ring means having an inner cylindrical surface coaxial with said central axis, said projection means on said vane means being engageable with said inner cylindrical surface such that during rotation of said rotor means, the resulting centrifugal force urges said vane means radially outwardly of the respective vane slot such that said projection means engages said inner cylindrical surface to limit the extent of outward radial movement of said vane means from its respective vane slot to preclude sliding contact between said vane means and said inner peripheral surface of said housing means, said ring means having an outer cylindrical ring surface and an end ring surface perpendicular to said central axis, and dynamic pressure producing groove means formed in said ring surfaces and operable during rotation of said ring means to provide a layer of said fluid between said ring surfaces and said recess walls to thereby minimize the frictional rotational resistance of said ring means in said recesses and thereby minimizing the sliding contact between said projection means and said inner cylindrical surface as said ring means rotate approximately in synchronism with said rotor means by the frictional engagement between said projection means and said inner cylindrical surface in said ring means.

9. A rotary machine according to claim 8, wherein each of said end walls which define the longitudinal ends of said rotor chamber has an outer radial end wall portion and an inner radial end wall portion, said outer radial end wall portion being axially spaced from said inner radial end wall portion, said recesses being disposed in said outer radial end wall portion of said housing means.

10. A rotary machine according to claim 9, wherein said recesses each have an inner radial cylindrical wall, said inner radial end wall portion of said housing means having an outer cylindrical wall which is axially aligned with said inner radial cylindrical wall of said recess.

11. A rotary machine according to claim 10, wherein said outer cylindrical wall of said inner radial end wall portion of said housing means has an axis coincident with said central axis.

* * * * *